United States Patent [19]

Colvin

[11] 4,312,345

[45] Jan. 26, 1982

[54] HYGIENIC CABINET

[76] Inventor: Johnnie F. Colvin, 305 Arkansas St., Ruston, La. 71270

[21] Appl. No.: 139,772

[22] Filed: Apr. 14, 1980

[51] Int. Cl.[3] ..... A61M 3/00

[52] U.S. Cl. ..... 128/229

[58] Field of Search ..... 128/229, 227, 230, 248

[56] References Cited

U.S. PATENT DOCUMENTS

| | | | |
|---|---|---|---|
| 1,752,698 | 4/1930 | Rogers et al. | 128/227 |
| 1,811,345 | 6/1931 | Bell | 128/227 |
| 2,522,122 | 9/1950 | Kertesz | 128/229 |
| 2,891,543 | 6/1959 | Bidlingmayer et al. | 128/248 |
| 2,922,421 | 1/1960 | Endrezze et al. | 128/227 |
| 3,044,465 | 7/1962 | Anderson et al. | 128/230 |
| 3,572,338 | 3/1971 | Murray, Jr. | 128/229 |

*Primary Examiner*—John D. Yasko

[57] ABSTRACT

A hygienic cabinet designed for mounting in the wall or vanity area in a bathroom which is provided with a hinged or sliding door and includes a container or holder for douche powder; a powder dispenser; a mixing or solution tank for mixing selected concentrations of douche solution; a water supply control and valving means for filling the tank, introducing the douche solution to the hygiene nozzle, and selectively introducing a supply of fresh water to the hygiene nozzle through a hose provided in a spring-loaded hose canister, which hose may be retracted in, and extended from, the cabinet as desired. The hygiene cabinet is provided with multiple brackets for removably securing the powder container and dispenser and the solution tank, as well as various other accessory items such as a spray adaptor for attachment to the retractable hose for shampoo purposes.

10 Claims, 7 Drawing Figures

HYGIENIC CABINET

BACKGROUND OF THE INVENTION

1. Field of the Invention

This invention relates to bathroom cabinets of recessed design and more particularly, to a hygienic cabinet which can be mounted in recessed fashion in the wall or in the vanity of a bathroom, and which contains special devices necessary for feminine hygiene. The hygienic cabinet of this invention represents an improvement over the prior art douche cabinet, since it is designed to facilitate mixing of douche solutions of selected concentration by use of a self-contained solution tank, a hot and cold water inlet regulator, a douche powder supply and dispenser, and a mixing valve for filling the tank, mixing the solution, draining the tank, and introducing fresh water directly to the hygiene nozzle. In a preferred embodiment of the invention the valve utilized to achieve selective directional flow of water and douche mixture is a three-way, four-position valve, which may be initially used to fill the solution tank, subsequently utilized to provide a stream of douche solution of selected concentration to the hygiene nozzle, and finally manipulated to facilitate a flow of fresh water through the hygiene nozzle.

The components of the hygiene cabinet of this invention are supported by brackets or are built into the cabinet as hereinafter described, with an inlet hot and cold water supply facilitated by a water inlet control which permits a selected blending of hot and cold water. The water inlet control may be connected to conventional plumbing as hereinafter described. In a preferred embodiment of the invention the hose used to direct douche solution or fresh water from the solution tank, and water from the water inlet control to the hygiene nozzle is retractably stored in a hose canister for convenience.

2. Description of the Prior Art

Because of their common and well known use in personal hygiene and sanitation, douche bags and accessory implements are normally placed in a drawer or cabinet in the bathroom out of sight when not in use. To many individuals, permitting the bag and accessory implements to remain in view is embarrassing, and in some instances indicative of a lack of delicacy. Furthermore, when the douche bag is in use it must be supported in an elevated position and in many bathrooms a convenient means for suspending the bag is not available. Accordingly, use of the bag on a periodic basis normally involves some degree of inconvenience and annoyance, and the necessary accessory implements such as the nozzle are sometimes difficult to locate when needed. Also, after use, the douche bag, tube and nozzle should be drained and allowed to dry before being again stored in the drawer or cabinet for future use, thereby generally necessitating suspension of the entire apparatus in full view in the bathroom.

Typical of the enclosures known in the prior art for containing douche bags and accessory implements is the utility cabinet disclosed in U.S. Pat. No. 2,156,131 to T. B. Stetzer, which includes a box-like enclosure used to support the bag. Similarly, U.S. Pat. No. 1,365,313 to R. S. C. Fow, and U.S. Pat. No. 1,858,146 to R. O. Ferguson also disclose cabinets or enclosures for enclosing douche bags. U.S. Pat. No. 920,225 to S. V. Van Denburgh, et al discloses an early water container or reservoir substituting for the conventional douche bag, with the accessory implements necessary for feminine hygiene also enclosed in the cabinet.

The prior art feminine hygiene enclosures and cabinets are subject to disadvantage of use in that most are simply covers for conventional douche bags and accessory articles. While the douche bag and articles are hidden from view, the enclosures containing them are not designed for use as an element in the hygiene procedure.

Accordingly, it is an object of this invention to provide a new and improved, self-contained hygienic cabinet which includes a hot and cold water supply; a mixing or solution tank; a container for douche powder; and all implements necessary for feminine hygiene, which cabinet is capable of being easily mounted in recessed fashion in the wall, vanity or lavatory area at the head of the bath tub or wall of the shower stall in the bathroom.

Yet another object of the invention is to provide a new and improved hygienic cabinet which includes a hot and cold water control means which may be connected to existing bathroom plumbing to facilitate mixing of douche powder in selected concentrations inside the cabinet by means of a three-way valve, a solution tank and a powder dispenser for introducing douche powder in known quantities into the solution tank.

Another object of the invention is to provide a new and improved hygienic cabinet which contains all of the necessary implements and water supply means for mixing and using a douche solution of selected concentration without the necessity of using a conventional douche bag.

A still further object of the invention is to provide a hygienic cabinet which is designed to conceal all of the articles necessary for feminine hygiene, and which further includes a solution tank having at least one transparent wall, a douche powder dispenser, a retractable hose and other implements required for quick, efficient and sanitary feminine hygiene.

A still further object of the invention is to provide a hygienic cabinet whch contains all of the implements and the ingredients necessary for feminine hygiene, including a non-corrosive solution tank for mixing douche solutions; a water control means for introducing a selected blend of hot and cold water into the tank or directly to the hygiene nozzle; and valve means for selectively filling the tank, introducing a flow of douche solution of selected concentration from the tank through a retractable hose to the nozzle, and supplying fresh water to the nozzle.

SUMMARY OF THE INVENTION

A hygienic cabinet which is designed for recessed mounting in the wall or vanity of a bathroom, or at the head of the bath tub or in the wall of a shower stall, which cabinet includes a self-contained design, a container for douche powder; a powder dispenser; a solution tank; a hot and cold water supply and valve means; and a retractable hose for initially filling the solution tank, dispensing a known quantity of powder in the tank to mix a douche solution of selected concentration, and dispensing the solution from the tank to the hygiene nozzle at a selected temperature and flow rate. The valve means is, in a preferred embodiment, a three-way, four-position valve which allows the tank to be initially filled with clear water of desired temperature, a mixed douche solution of selected concentration to flow to the nozzle by a second manipulation of the valve, and clear water to flow directly to the nozzle by a third valve position.

BRIEF DESCRIPTION OF THE DRAWING

The invention will be better understood by reference to the accompanying drawing, wherein.

DESCRIPTION OF THE PREFERRED EMBODIMENTS

Figure 1:
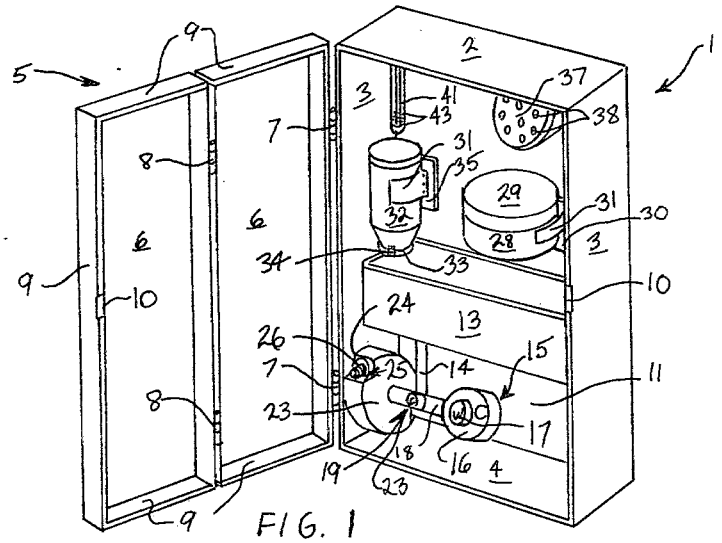
FIG. 1 is a perspective view of a preferred embodiment of the hygienic cabinet of this invention.
Figures 2, 3:
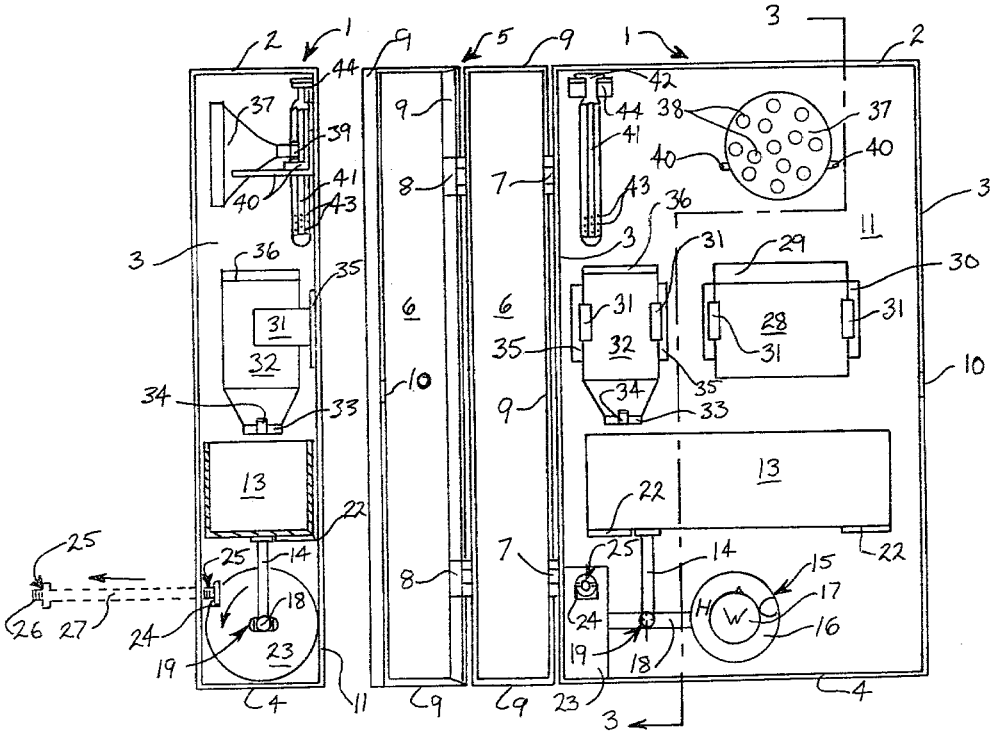
FIG. 2 is a front elevation of the hygienic cabinet illustrated in FIG. 1.
FIG. 3 is a side sectional view of the hygienic cabinet illustrated in FIG. 2, taken along lines 3—3 in FIG. 2.

Referring now to FIGS. 1–3 of the drawing, the hygienic cabinet of this invention is generally illustrated by reference numeral 1, and is constructed in a generally rectangular configuration of selected size, and is defined by a top 2, side walls 3, a bottom 4, and a rear wall 11, as illustrated in FIG. 1. In a preferred embodiment of the invention a closure 5 is defined by a pair of closure panels 6, connected by panel hinges 8 annd joined to hygienic cabinet 1 by means of closure hinges 7, as illustrated in FIGS. 1 and 2. Panel edge 9 serves to facilitate a closing of hygienic cabinet 1 on closure hinges 7 when the cabinet is not in use. When closure 5 is closed against top 2, side walls 3 and bottom 4, magnetic stays 10 engage and serve to maintain the closed configuration of hygienic cabinet 1. As illustrated in FIGS. 1 and 2, closure 5 is preferably defined by a pair of closure panels 6 in hinged relationship on panel hinges 8 in order to facilitate convenient opening of closure 5 under circumstances where hygienic cabinet 1 may be positioned in the bathroom wall, or in a vanity wall or at the head of a bath tub or in a shower stall wall near obstacles such as the toilet tissue holder, or in other relatively inaccessible locations. While closure 5 is preferably characterized by closure panels 6, it will be recognized by those skilled in the art that alternative means for closing hygienic cabinet 1, such as a sliding closure or door, will be apparent, depending upon the particular space and convenience requirements and the specific positioning of the cabinet in the bathroom.

Referring again to FIGS. 1–3, in another preferred embodiment of the invention hygienic cabinet 1 is provided with a solution tank 13, which is preferably molded from a transparent plastic or provided with a transparent outside wall in order that the water level might be readily ascertained, the tank being positioned in hygienic cabinet 1 by means of a tank bracket 22, more particularly illustrated in FIG. 3 of the drawing. Solution tank 13 is further provided with a downwardly extending length of tank conduit 14, which joins a length of water inlet conduit 18 at control valve 19. One end of water inlet conduit 18 is attached to water inlet control 15, which includes a control flange 16, connected to existing hot and cold water pipes (not illustrated) in the bathroom, and a control knob 17, which permits a blending of hot and cold water by manipulation with respect to control flange 16. The opposite end of water inlet conduit 18 is attached to a hose canister 23, which carries a hose 27 in spring-loaded, retractable configuration, and is provided with a conventional slip-ring and sealing means which permits clear water or a water solution to flow from water inlet conduit 18 through hose 27 without leakage in hose canister 23 according to the knowledge of those skilled in the art. The free end of hose 27 is provided with a hose fitting 25, having fitting threads 26 on the projecting end thereof. Hose canister 23 is also provided with a canister notch 24 to accommodate hose fitting 25 in recessed fashion. Alternatively, hose 27 can be directly attached to water inlet conduit 18, and can be allowed to loop through an aperture in bottom 4 of hygienic cabinet 1 in the same manner as a spray nozzle attachment on a conventional sink, when the hose 27 is not in use.

Figures 4, 5, 6, 7:
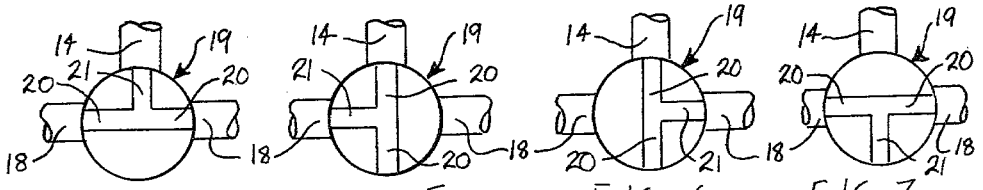
FIG. 4 is a sectional schematic of the valve mounted in the hygienic cabinet illustrated in FIGS. 1–3, with the valve in functional position to simultaneously permit a solution of douche powder to flow from the solution tank, and fresh water to flow to the nozzle.
FIG. 5 is a sectional schematic of the valve illustrated in FIG. 4 in position to facilitate a flow of douche solution from the tank to the nozzle.
FIG. 6 is a sectional schematic of the valve in functional position to permit the filling of the solution tank.
FIG. 7 is a sectional schematic of the valve in position to permit fresh water only to flow to the nozzle.

Referring now to FIGS. 4–7 of the drawing, in a preferred embodiment of the invention control valve 19 is characterized as a conventional three-way valve, which is provided with a valve run passage 20 and a connecting valve branch passage 21, both of which passages can be adjusted in conventional fashion to direct the flow of water or other fluid according to the desires of the user. For example, referring again to FIGS. 1 and 4, when the valve is in the position illustrated in FIG. 4, water is permitted to flow from water inlet control 15 through valve run passage 20 to hose canister 23 and to hygiene nozzle 21. Furthermore, a mixed douche solution is also permitted to flow from solution tank 13 through tank conduit 14, valve branch passage 21 and half of valve run passage 20 and water inlet conduit 18 to hose canister 23 and hygiene nozzle 21. Referring to FIG. 5 of the drawing, in this valve configuration, douche solution only is permitted to flow from solution tank 13, through tank conduit 14, valve run passage 20, valve branch passage 21, and water inlet conduit 18 to hose canister 23, hose 27 and hygiene nozzle 21. Referring to FIG. 6, in this valve configuration water of selected temperature is permitted to flow from water inlet control 15 through water inlet conduit 18, valve branch passage 21, one-half of valve run passage 20 and tank conduit 14, into solution tank 13, to fill the tank. Referring to FIG. 7 of the drawing, when the valve is in the configuration illustrated, clear water is permitted to flow from water inlet control 15 through water inlet conduit 18 and valve run passage 20, and on to hose canister 23, hose 27, and hygiene nozzle 21.

Referring again to FIGS. 1–3 of the drawing, the hygienic cabinet 1 of this invention further includes a powder container 28, containing a supply of douche powder and fitted with a powder container lid 29, with powder container 28 removably inserted in a powder container bracket 30, fitted with bracket clamps 31 for convenience in use. A powder dispenser 32 is provided in side-by-side relationship to powder container 28, and is also provided with a dispenser lid 36 for access to the interior of the dispenser. Powder dispenser 32 also includes a dispenser nozzle 33, positioned immediately above the open top of solution tank 13, and is fitted with a dispenser lever 34 which may be manipulated to permit a controlled or predetermined quantity of douche powder to dispense into solution tank 13. As in the case of powder container 28, powder dispenser 32 is preferably mounted in a dispenser bracket 35, provided with a pair of bracket clamps 31 in order to removably secure the dispenser inside hygienic cabinet 1. It will be appreciated that powder dispenser 32 may be calibrated to permit a controlled and known quantity of douche powder to dispense into solution tank 13 for each manipulation of dispenser lever 34 in order to provide a douche solution of selected concentration in solution tank 13. It will be further recognized by those skilled in the art that solution tank 13 may be provided with graduations on the transparent exterior wall in order that the exact volume of water might be determined as the tank is filled in order to better facilitate a mixing of a desired concentration of douche solution. Furthermore, the hygiene nozzle illustrated by reference numeral 21 may be mounted in a nozzle bracket 44 provided in hygiene cabinet 1 as illustrated in FIGS. 1–3, in similar fashion to powder dispenser 32. Hygiene nozzle 41 is preferably constructed in conventional fashion with a nozzle flange 42 of sufficient size to insure sanitation in use, and with nozzle apertures 43 provided to facilitate a flow of water or douche solution through hose 27 and hygiene nozzle 41. In a preferred embodiment of the invention other accessory items such as a spray adaptor 37, fitted with adaptor apertures 38, may be mounted in hygiene cabinet 1 by means of an adaptor bracket 40, more particularly illustrated in FIG. 3 of the drawing. Spray adaptor 37 may further be provided with an adaptor fitting 39, which is designed to mate with fitting threads 26 on hose fitting 25 to facilitate the use of hygiene cabinet 21 in shampooing the hair, or other uses as desired.

Referring again to the drawing the hygienic cabinet 1 of this invention is used by initially opening closure 5, and folding closure panels 6 against each other on panel hinges 8 as desired in order to expose the interior of the cabinet for use. Control knob 17 is then positioned between the hot and cold water marks according to the estimated blend of hot and cold water desired, and control valve 19 is manipulated to the position illustrated in FIG. 7. Control knob 17 is then further manipulated to initiate a flow of water through water inlet conduit 18, valve run passage 20 of control valve 19, and through hose canister 23 into hose 27, which has been retracted from hose canister 23. When the stream of water flows from hose fitting 25, control knob 17 is manipulated to provide a proper blend of hot and cold water, and control knob 17 is then closed. Hygiene nozzle 41 is then removed from nozzle bracket 44 and threadably attached to fitting threads 26 provided on hose fitting 25, and control knob 17 is again opened. Solution tank 13 is then filled with a selected quantity of water by manipulating control valve 19 to the position illustrated in FIG. 6, with water entering water inlet conduit 18, valve branch passage 21, valve run passage 20, and finally tank conduit 14 and solution tank 13. When solution tank 13 is filled to the proper depth with water, control knob 17 is again closed and a selected quantity of douche powder in powder dispenser 32 is introduced into solution tank 13 by manipulation of dispenser lever 34, and the contents may be stirred to thoroughly dissolve the powder in the water. In the alternative, it will be recognized that douche powder may be first introduced into solution tank 13 and the water subsequently permitted to flow into the tank to better facilitate dissolving the powder in the water. When the contents of solution tank 13 are thoroughly mixed, the solution is allowed to flow from solution tank 13 to hygiene nozzle 41 at a controlled rate by manipulation of control valve 19 to the position illustrated in FIG. 5. It will be appreciated that a controlled rate of fluid flow may be achieved through control valve 19 by manipulating valve run passage 20 and valve branch passage 21 from the full flow position illustrated in FIG. 5, to a partial flow configuration determined by partial registration of valve run passage 20 with tank conduit 14, and valve branch passage 21 with water inlet conduit 18. When a selected quantity of solution in solution tank 13 is caused to flow through hygiene nozzle 41, a pure stream of water may then be used to flush hose 27 and hygiene nozzle 41, by again positioning the valve in the configuration illustrated in FIG. 7. Furthermore, it will be appreciated that solution tank 13 can be rinsed and drained by repeating the filling procedure outlined above without the introduction of the douche powder into solution tank 13. Accordingly, douche solution can be mixed and dispensed without the necessity of using conventional douche bags by use of the hygienic cabinet of this invention.

It will also be apparent to those skilled in the art from a consideration of the drawing and the above description, that the flow of douche solution from solution tank 13 can be facilitated not only by gravity, but also by fluid aspiration under circumstances where it is desired to use a fresh water stream and a simultaneous flow of douche solution through water inlet conduit 18 and hose 27 into hygiene nozzle 41. This flow condition is facilitated by manipulating control valve 19 in the configuration illustrated in FIG. 4 of the drawing, and may be used where it is desired to further dilute, or to increase the flow rate of the douche solution, or both. It will be further appreciated by those skilled in the art that other accessory items can also be placed in the hygienic cabinet by the simple expedient of providing additional brackets to accommodate such accessories. Furthermore, the size and exact positioning and location of hose canister 23, water inlet control 15, solution tank 13, powder container 28, and powder dispenser 32 may be varied, as desired, depending upon the particular needs of the user. It is further apparent that connection of conventional water inlet control 15 to the hot and cold water lines currently existing in the bathroom area may be made in conventional fashion by either threaded or soldered fittings as desired, according to the knowledge of those skilled in the art.

Having described my invention with the particularity set forth above, what is claimed is:

1. A hygienic cabinet comprising:

(a) an enclosure;

(b) a tank mounted in said enclosure;

(c) hose means mounted in said enclosure beneath said tank;

(d) water supply means mounted in said enclosure and connected to a source of water;

(e) water conduit means connecting said tank, said hose means and said water supply means; and (f) a three-way, four position valve cooperating with said conduit means for selectively permitting water to flow from said water supply means to said tank and said hose means, and fluid to flow from said tank to said hose means.

2. The hygienic cabinet of claim 1 wherein said enclosure is a generally rectangular-shaped cabinet having a door for access to the interior thereof.

3. The hygienic cabinet of claim 1 further comprising powder dispensing means removably mounted in said enclosure above said tank.

4. The hygienic cabinet of claim 1 wherein said hose means is a canister and a hose retractably coiled in said canister.

5. The hygienic cabinet of claim 1 wherein said enclosure is a generally rectangular-shaped cabinet having a door for access to the interior thereof, and further comprising a powder dispensing means removably mounted in said enclosure above said tank.

6. The hygienic cabinet of claim 1 further comprising a powder dispensing means removably mounted in said enclosure above said tank, and wherein said hose means is a canister and a hose retractably coiled in said canister.

7. The hygienic cabinet of claim 1 further comprising a feminine hygiene nozzle and a container for a supply of feminine hygiene powder removably positioned in said enclosure.

8. The hygienic cabinet of claim 1 wherein said enclosure is a generally rectangular-shaped cabinet provided with a door for access to the interior thereof, and further comprising powder dispensing means removably mounted in said enclosure above said tank and a feminine hygiene nozzle and a container for a supply of feminine hygiene powder removably positioned in said cabinet.

9. A hygenic cabinet comprising:

(a) an enclosure having a top, a bottom, side walls connecting said top and said bottom, a rear wall, and a door closing said top, said bottom and said side walls;

(b) water supply means mounted in said cabinet and connected to a source of hot and cold water;

(c) a solution tank for holding a supply of liquid mounted in said cabinet;

(d) a hose canister mounted in said cabinet beneath said solution tank and a hose retractably cooperating with said hose canister;

(e) a water inlet conduit having one end attached to said water supply means and the opposite end carried by said hose to permit water to flow from said water supply means to said hose;

(f) a three-way, four position valve positioned in said water inlet conduit for selectively controlling the flow of water directly to said hose, to said solution tank and to said hose and said solution tank simultaneously and controlling the flow of solution from said solution tank to said hose, respectively;

(g) a tank conduit having one end opening into said solution tank and the opposite end attached to said valve; and (h) attachment means on the free end of said hose to removably secure a nozzle to said hose.

10. The hygenic cabinet of claim 9 further comprising powder dispensing means removably mounted in said enclosure above said tank for selectively dispensing powder into said tank and a spray adapter removably mounted in said enclosure for removable attachment to said hose to dispense a stream of water from said hose.

* * * * *